United States Patent [19]

Carrasco

[11] Patent Number: 4,901,817

[45] Date of Patent: Feb. 20, 1990

[54] EXPLOSIVE RELEASE WINDOW GRILLE

[76] Inventor: Fernando M. Carrasco, 1225 Broadway #1101, Chula Vista, Calif. 92011

[21] Appl. No.: 371,632

[22] Filed: Jun. 26, 1989

[51] Int. Cl.[4] ..... E06C 9/10; E06B 3/68

[52] U.S. Cl. ..... 182/21; 182/97; 49/56

[58] Field of Search ..... 182/20, 21, 97, 18, 182/19; 49/56; 52/98

[56] References Cited

U.S. PATENT DOCUMENTS

| | | | |
|---|---|---|---|
| 1,629,541 | 5/1927 | Scholer | 182/21 |
| 3,670,846 | 6/1972 | Jones | 182/20 |
| 3,694,003 | 4/1972 | Radke | 280/150 |
| 3,946,833 | 3/1976 | Riehlmann | 182/20 |
| 4,057,935 | 6/1977 | Rohrberg | 49/56 |
| 4,127,966 | 9/1978 | Schmidt | 49/141 |
| 4,237,654 | 5/1980 | Landem et al. | 49/141 |
| 4,263,747 | 11/1981 | Coltrin | 49/56 |
| 4,476,957 | 10/1984 | Ory | 182/21 |
| 4,679,365 | 4/1987 | Herring | 52/204 |
| 4,685,316 | 3/1987 | Hicks et al. | 70/256 |

*Primary Examiner*—Reinaldo P. Machado

*Attorney, Agent, or Firm*—Charles C. Logan, II; David L. Baker

[57] ABSTRACT

An explosive release window grille system for the window of a house or building. It has a window grille formed from a plurality of laterally spaced vertical bars that are rigidly secured in a grid-like structure by a plurality of horizontal bars. The bottom ends of the vertical bars have an eyelet loop formed in them and a bottom horizontal bar passes therethrough and functions as a shaft about which the window grille can pivot outwardly and downwardly. The opposite ends of the bottom horizontal bracket are secured to the outer wall surface by mounting bracket assemblies. The top horizontal bar has its opposite ends secured to the front wall surface by explosive release bracket assemblies. Each of these assemblies include exploding bolts having an explosive charge mounted in their shank. The bolts are inserted through the wall from the inner surface and their tips are captured by the brackets mounted on the outer surface of the wall. A remotely mounted control panel is electrically connected to the exploding bolts and they are detonated by an electrical impulse sent through the conductor wire. Once the bolts have been detonated, the window grille is pivoted outwardly and downwardly so that it can function as a ladder.

6 Claims, 1 Drawing Sheet

EXPLOSIVE RELEASE WINDOW GRILLE

BACKGROUND OF THE INVENTION

The invention relates to windows and more specifically to a unique structure for releasably securing a window grille over the window of a house or building.

Decorative metal grilles and grates have been used for many years to enhance the beauty of houses and at the same time secure the window and other openings to prevent unauthorized entry. In early times, these grates were permanently affixed to the structure about the window, however, it quickly became apparent that not only did such grilles prevent entry from the outside, but they also prevented emergency exit from within the building, many times with tragic results. Thereafter grilles have been hinged and lock mechanisms are employed to retain the grille in position blocking the window except during times of emergency. If the key or other device required to open the lock mechanism is placed remotely from the mechanism, the grille becomes dangerous especially to strangers or children attempting to open the grille. When easily manipulated mechanism are employed, a screen or mesh must be used in addition to the grille to prevent an intruder from reaching through the grille and unlocking the mechanism.

It is an object of the invention to provide a novel explosive release window grille system that provides both desirable burgular proof protection and quickly accessible emergency exits.

It is also an object of the invention to provide a novel explosive release window grille system that can be easily installed.

It is another object of the invention to provide a novel explosive release window grille system that is simple to operate.

It is an additional object of the invention to provide a novel explosive release window grille system that allows the window grille to be pivoted outwardly and downwardly so that it can function as a ladder.

It is a further object of the invention to provide a novel explosive release window grille system that is economical to manufacture and market.

SUMMARY OF THE INVENTION

Applicant's novel explosive release window grille system has been designed to cover the windows of a house or building. The window grille itself is formed from a plurality of laterally spaced vertical bars that are formed into a rigid grid by a plurality of horizontal bar members. A top horizontal bar is rigidly secured to the vertical bars adjacent their top ends. The bottom ends of the vertical bars have an eyelet loop formed on them.

A bottom horizontal bar is threaded through the eyelet loops of the vertical bars and it functions as a shaft about which the window grille can pivot outwardly and downwardly when the structure holding the top end of the window grille has been released. Once the window grille is hanging downwardly below the window, it can be utilized as a ladder and the horizontal bars function as rungs of the ladder. The opposite ends of the bottom horizontal bar are journaled in mounting bracket assemblies that are secured to the outer surface of the wall of the house or building. The hardware securing these mounting bracket assemblies are inserted through the inner surface of the wall and engage the mounting bracket assemblies on their rear surface so that there is no fastening structure visible on the exterior of the mounting bracket assembly that can be loosened by an intruder.

The opposite ends of the top horizontal bar are secured to explosive release bracket assemblies. Each of these assemblies has a recess formed in their rear surface for receiving the top horizontal bar. The rear surface of the bracket also receives the threaded tip of an exploding bolt. The head of the exploding bolt tightens up against the inner surface of the wall and its shank, which has an explosive charge therein, passes through the wall. Again there is no fastening structure accessible from the exterior of the house or building that may be unfastened by an intruder.

A control box is remotely mounted on the inner surface of the wall of the house or building and it is electrically connected to the head of the respective exploding bolts by an electrical circuit that has its own battery source of electrical power. The control panel has a cover, which when open, gives access to the switch which is used to send an electrical pulse to the exploding bolts. When this occurs, the shank of the exploding bolt is ruptured and the window grille can be pushed outwardly so that it pivots downwardly below the window itself to provide a full sized emergency exit from the interior of the house or building.

An alternative circuit can be electrically connected to the exploding bolts so that they will function when the heat in the room becomes excessive, for instance 160 degrees F. or higher. This embodiment would have a bi-metallic sensor that would close the electrical circuit and thus cause the bolts to explode without the need for a person to physically actuate the control switch. The bi-metallic sensor would be mounted near the ceiling or at the top of the window frame. Thus in the event of a fire where adults are incapacitated and cannot reach a child's room or nursery, the bolts would automatically fire as temperatures near the upper window frame became excessive. The fireman could then rescue any occupants within the room.

DESCRIPTION OF THE PREFERRED EMBODIMENT

Figure 1:
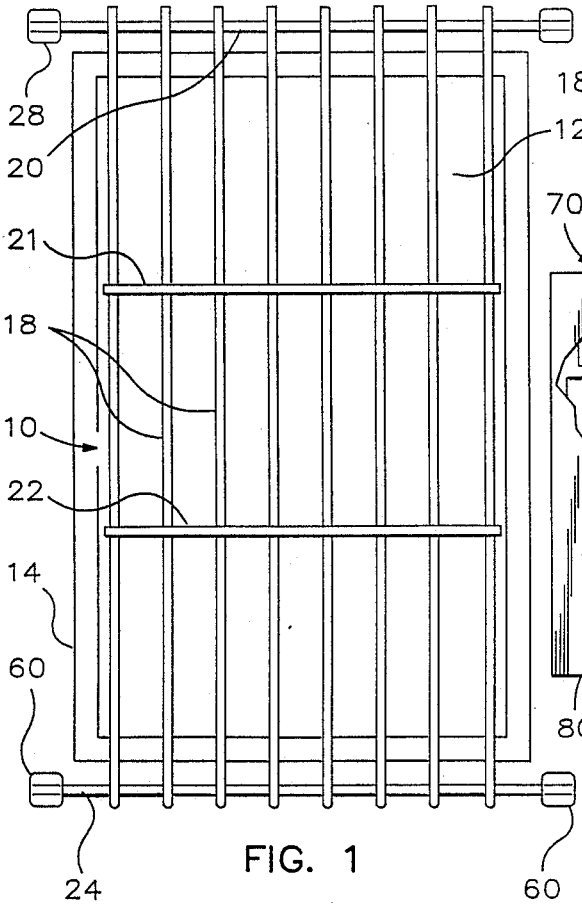
FIG. 1 is a front elevation view of applicant's novel explosive release window grille system as viewed from the outside of a building.
Figure 2:
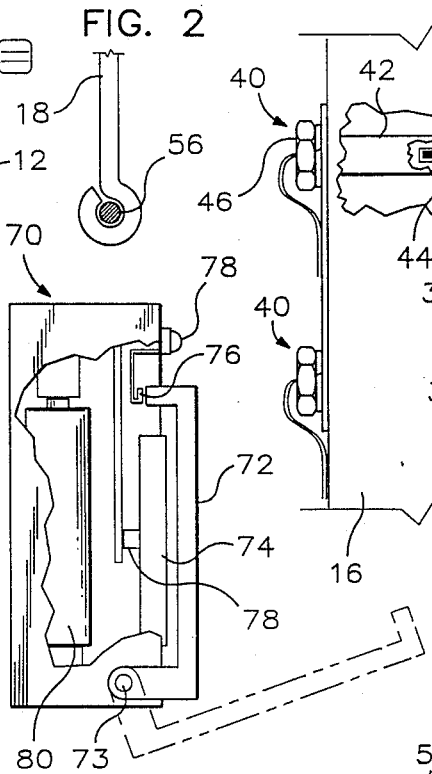
FIG. 2 is a side elevation view of the bottom end of one of the vertical bars of the window grille.

The explosive release window grille system will now be described by referring to FIGS. 1–7 of the drawings.

Window grille 10 covers a window 12 in window frame 14 of wall 16. It is formed from a plurality of vertical bars 18, top horizontal bar 20, intermediate horizontal bars 21 and 22 and bottom horizontal bar 24.

Figure 4:
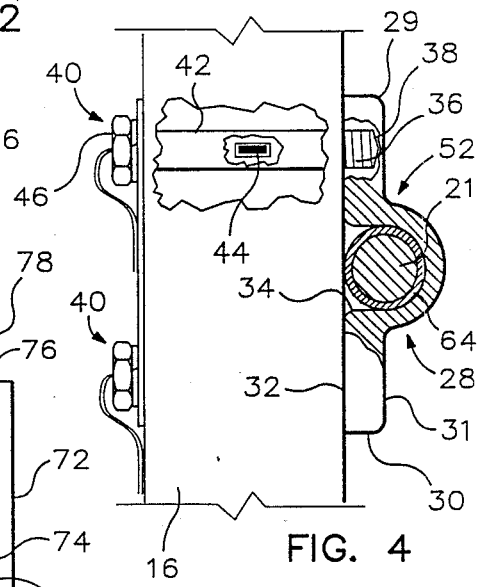
FIG. 4 is a cross sectional view of the wall of the room showing the manner in which the exploding bolts and explosive release bracket assembly are secured thereto.
Figure 6:
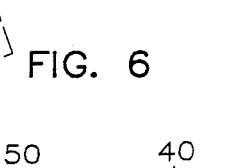
FIG. 6 is a side elevation view of the control box with portions broken away.
Figure 7:
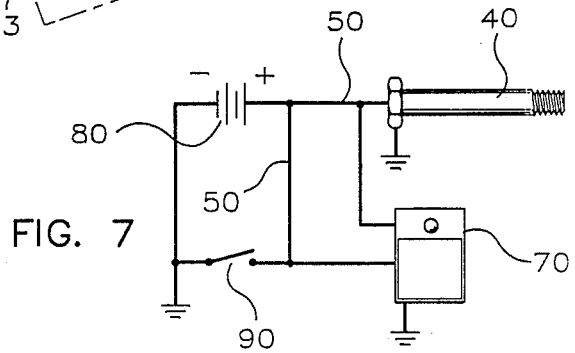
FIG. 7 is a schematic diagram of the electrical circuit of the explosive release grille system.
Figure 5:
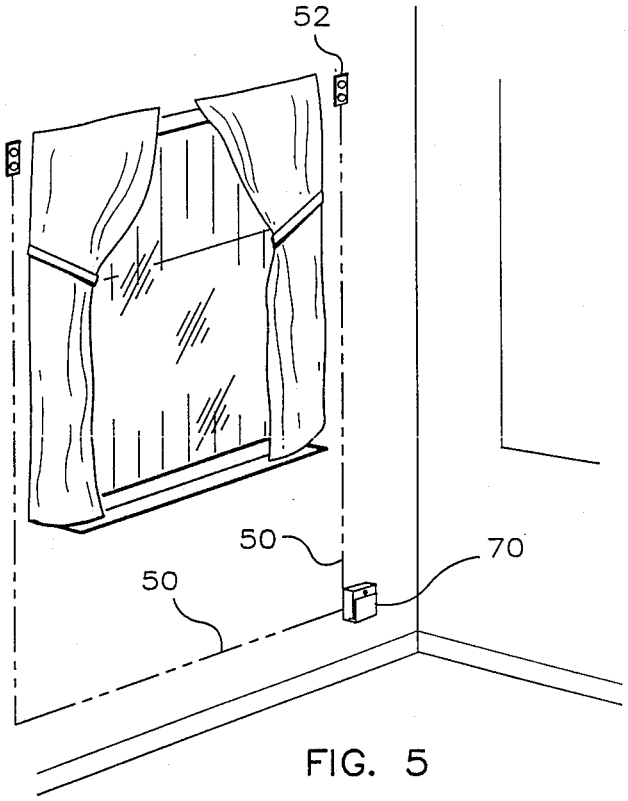
FIG. 5 is a front perspective view of the interior of a room having a window grille covering its window
Figure 3:
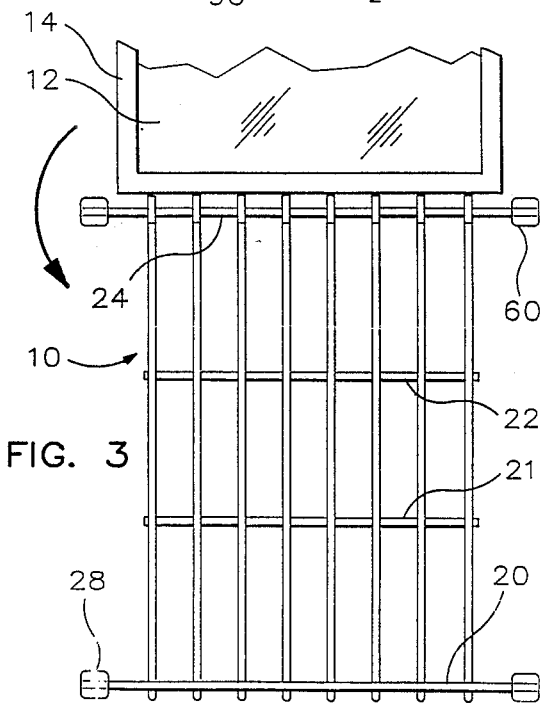
FIG. 3 is a side elevation view showing the window grille after it has been pivoted outwardly and downwardly around the bottom horizontal bar.

The opposite ends of top horizontal bar 20 are captured in brackets 28. In FIG. 4 these brackets are seen to have a top edge 29, a bottom edge 30, a front surface 31 and a rear surface 32. A recess 34 is formed in rear surface 32 and its receives top horizontal bar 21 therein. Threaded bores 36 are also formed in rear surface 32 for receiving the tips 38 of exploding bolts 40. The shank 42 of the exploding bolts contains an explosive charge 44 therein. The head 46 of the exploding bolts has electrical wires 50 connected to them. Exploding bolt 40 and bracket 28 form the explosive release bracket assembly 52.

The bottom end of the vertical bars 18 have an eyelet loop 56 formed therein. Bottom horizontal bar 24 passes through these aligned apertures and its opposite ends are captured in brackets 60 that are similar in structure to mounting brackets 28. Both top horizontal bar 20 and bottom horizontal bar 24 have rubber coated tips or rubber sleeve end caps on their ends in order to prevent the frame from rattling in the wind. This structure is identified by numeral 64.

A remotely positioned control box 70 has a cover plate 72 having a spring hinge 73 which keeps the cover plate closed over emergency button 74. If the owner wishes to test the system, pressing on cover plate 72 will cause it to make contact with contact point 76 which lights test indicator lamp 78. If indicator lamp 76 illuminates, there is enough power to activate the system.

The operation to activate the system and explodes the bolts in case of emergency, requires the cover 72 to be lowered and emergency button 74 is pressed inwardly until it touches contact 78 which is connected to wire 50 that is also connected to batteries 80.

An auxillary unit can also be wired into the electrical circuit and it would have a bimetallic sensor 90 which would close the circuit when heat becomes excessive, for instance 160 degrees F. When this temperature is reached it would close the electrical circuit and cause the exploding bolts to rupture. Sensor 90 would be mounted near the ceiling or at the top of the window frame.

The drawings as shown and thusly described represent the preferred embodiment of the invention. It would be obvious to one skilled in the art that various changes and modification, simple or complex, could be made to the preferred embodiment which would alter the appearance but not the scope, spirit and intention of the invention. It is the invention of the inventor to preclude the occurence of such emulations in design, scope or spirit through the following claims.

What is claimed is:

1. An explosive release window grille system comprising:

a window grille formed from a plurality of laterally spaced vertical bars each having a top end and a bottom end, a top horizontal bar is rigidly secured to said vertical bars adjacent their top ends, the bottom ends of said vertical bars have an eyelet loop formed on them, a bottom horizontal bar passes through said eyelet loops to function as a hinge about which said window grille can pivot downwardly about to provide an escape exit through a window that the window grille normally covers;

said bottom horizontal bar having a first end and a second end;

a pair of mounting bracket assemblies; one mounting bracket assembly is for securing the first end of said bottom horizontal bar to the wall of a house or building beneath a window covered by the window grille, the other mounting bracket is for securing the second end of the bottom horizontal bar to the wall of the house or building;

said top horizontal bar having a first end and a second end; and a pair of explosive release bracket assemblies for securing the respective first and second ends of said top horizontal bar to the wall of a house or building above a window covered by the window grille.

2. An explosive release window grille system as recited in claim 1 wherein each of said explosive release bracket assemblies comprises a bracket having a front surface, a rear surface, a top edge and a bottom edge, said bracket having structure engaging said top horizontal bar, at least one exploding bolt for each bracket and it would pass through the wall of a house or building from its inside surface to its outside surface.

3. An explosive release window grille system as recited in claim 2 wherein the rear surface of said bracket has threaded bores for receiving each of said exploding bolts.

4. An explosive release window grille system as recited in claim 3 wherein each of said exploding bolts has a shank in which is received an explosive charge for rupturing said shank.

5. An explosive release window grille system as recited in claim 2 further comprising means for sending an electrical impulse through a wire connected to said exploding bolts.

6. An explosive release window grille system as recited in claim 1 further comprising at least one intermediate horizontal bar that is rigidly secured to said vertical bars and they function as rungs of a ladder when said window grille pivots outwardly and downwardly about said bottom horizontal bar.

* * * * *